US009248336B2

(12) United States Patent
Deis

(10) Patent No.: US 9,248,336 B2
(45) Date of Patent: Feb. 2, 2016

(54) MULTIPURPOSE EXERCISE APPARATUS

(71) Applicant: PERFECT BALANCE REHABILITATION, Medicine Hat (CA)

(72) Inventor: Dale Deis, Medicine Hat (CA)

(73) Assignee: PERFECT BALANCE REHABILITATION, Medicine Hat (CA)

( * ) Notice: Subject to any disclaimer, the term of this patent is extended or adjusted under 35 U.S.C. 154(b) by 0 days.

(21) Appl. No.: 14/377,986

(22) PCT Filed: Sep. 4, 2013

(86) PCT No.: PCT/CA2013/000760
§ 371 (c)(1),
(2) Date: Aug. 11, 2014

(87) PCT Pub. No.: WO2014/036637
PCT Pub. Date: Mar. 13, 2014

(65) Prior Publication Data

US 2015/0031514 A1 Jan. 29, 2015

Related U.S. Application Data

(60) Provisional application No. 61/697,203, filed on Sep. 5, 2012.

(51) Int. Cl.

| | |
|---|---|
| ***A63B 21/00*** | (2006.01) |
| ***A63B 17/00*** | (2006.01) |
| ***A63B 21/068*** | (2006.01) |
| ***A63B 23/02*** | (2006.01) |
| ***A63B 21/16*** | (2006.01) |

(52) U.S. Cl.
CPC ..... *A63B 21/1457* (2013.01); *A63B 17/00* (2013.01); *A63B 21/00047* (2013.01);

(Continued)

(58) Field of Classification Search
CPC ..... A63B 3/00; A63B 6/00; A63B 21/00047; A63B 21/0005; A63B 21/00054; A63B 21/00105; A63B 21/068; A63B 23/0205; A63B 21/00185; A63B 21/1457; A63B 23/0211; A63B 23/0216; A63B 23/0233
USPC ..... 482/38, 41, 95–96, 123, 130, 133–138, 482/140, 142–145; 297/452.41, 217.7
See application file for complete search history.

(56) References Cited

U.S. PATENT DOCUMENTS 4,872,670 A * 10/1989 Nichols ..... 482/135
6,547,706 B1 4/2003 Chek (Continued)

FOREIGN PATENT DOCUMENTS

CA 2794479 9/2011

OTHER PUBLICATIONS

Notification of Transmittal of the International Search Report and the Written Opinion of the International Searching Authority, or the Declaration, Nov. 18, 2013, Canadian Intellectual Property Office, Gatineau, Canada.

(Continued)

*Primary Examiner* — Oren Ginsberg
*Assistant Examiner* — Jennifer M Deichl

(57) ABSTRACT

An exercise apparatus for cooperating with an exercise ball during performance of core exercises thereon. The exercise apparatus comprises: (i) an exercise platform comprising a framework defining a first opening approximate its proximal end for receiving therein a first padded exercise mat and a second opening approximate its distal end for receiving therein a second padded exercise mat; (ii) an upright framework engaged with the exercise platform framework at its proximal end, the upright framework having a vertically adjustable backplate with an adjustable headrest and an adjustable handlebar grip, a handgrip support rail and a stabilizer bar integrally engaged with the proximal end of the exercise platform; (iii) a first padded exercise mat for demountable installation into the first opening defined in the exercise platform framework; and (iv) a second padded exercise mat for demountable installation into the first opening defined in the exercise platform framework.

13 Claims, 11 Drawing Sheets

(52) U.S. Cl.
CPC ..... *A63B21/00185* (2013.01); *A63B 21/068* (2013.01); *A63B 21/16* (2013.01); *A63B 23/0211* (2013.01); *A63B 23/0216* (2013.01); *A63B 23/0233* (2013.01); *A63B 21/1469* (2013.01); *A63B 2210/50* (2013.01)

(56) References Cited

U.S. PATENT DOCUMENTS

| | | | | |
|---|---|---|---|---|
| 6,551,219 | B1 * | 4/2003 | Brown | 482/57 |
| 6,689,026 | B2 | 2/2004 | Almada | |
| 6,699,162 | B2 | 3/2004 | Chen | |
| 7,115,080 | B2 | 10/2006 | Cockrill, Jr. et al. | |
| 7,819,781 | B1 | 10/2010 | Maldonado | |
| 7,878,954 | B2 * | 2/2011 | McBride et al. | 482/123 |
| 2006/0247097 | A1 * | 11/2006 | La Voie et al. | 482/8 |
| 2009/0069161 | A1 * | 3/2009 | Caldwell | 482/138 |

OTHER PUBLICATIONS

International Preliminary Report on Patentability in Canadian PCT Application No. PCT/CA2013/000760, dated Mar. 19, 2015.

* cited by examiner

MULTIPURPOSE EXERCISE APPARATUS

This application is a national phase application under 35 U.S.C. § of International Patent Application No. PCT/CA2013/000760 filed on Sep. 4, 2013, which claims the benefit of U.S. Provisional Application Ser. No. 61/697,203 filed on Sep. 5, 2012, the entire text of each of the above-referenced disclosures is specifically incorporated herein by reference without disclaimer.

TECHNICAL FIELD

The present disclosure relates generally to exercise equipment. More specifically, the present disclosure relates to multipurpose exercise apparatus that can be used in combination with exercise balls.

BACKGROUND

Exercise is an important part of many people's daily lives. It is well known that regular exercise is a significant factor in maintaining physical fitness, controlling weight, improving intellectual functioning, and emotional well being. Exercises aimed at strengthening the back and abdominal muscles, also referred to as the "core" muscles, are known to be particularly beneficial. However, a significant challenge the many different forms and types of core exercises is that the person must place their body in contact with a floor or other hard surface. Extending contacting with hard surfaces while performing core exercises may cause discomfort and/or pain for many people, in particular, those who are just commencing with regular exercise routines.

One way of reducing discomfort and pain during performance of core exercises is to position a person's back or alternatively their abdomen or alternatively, their sides on an exercise ball while they are exercising. Exercise balls are also commonly known as Swiss balls, balance balls, body balls, pilates balls, yoga balls. Exercise balls are typically constructed of soft pliable and elastic polymers and generally available in a broad range of diameters between 14 inches to about 48 inches. The air pressure within the exercise ball may be adjusted as desired by a user to provide a desired degree of comfort and stability when the ball is used to support the user's body during their execution of core exercises. It is known that the use of exercise balls to support a user's body while performing core exercises will result in continuous positional instability during the full range of body movements thereby assisting in strengthening of the core muscles because they are directly engaged in stabilization of the body while it is in motion on the exercise ball.

A problem commonly encountered with the use of exercise balls, particularly those in the early stages of developing a routine exercise program, is that a user may have difficulty maintaining their balance on the exercise ball during the exercise resulted in unexpected falls or slipping of the exercise ball resulting in bruising and more serious injuries. Falls and slipping by users may be due to a lack of gripping surfaces or devices on the balls or adjacent to the balls to enable the user to stabilize themselves. Furthermore, where a user may be able to locate walls, bars or other objects to hold onto during the exercise, such surfaces may provide insufficient strength to properly stabilize the user. Additionally, the surfaces that a user may be able to find in a given location may be insufficient to provide the variety of grips desired by a user.

SUMMARY

The exemplary embodiments of the present disclosure pertain to exercise apparatus for cooperating with an exercise ball during performance of core exercises thereon. The exercise apparatus comprises: (i) an exercise platform comprising a framework defining a first opening approximate its proximal end for receiving therein a first padded exercise mat and a second opening approximate its distal end for receiving therein a second padded exercise mat; (ii) an upright framework engaged with the exercise platform framework at its proximal end, the upright framework having a vertically adjustable backplate with an adjustable headrest and an adjustable handlebar grip, a handgrip support rail and a stabilizer bar integrally engaged with a lower portion of the upright framework; (iii) a first padded exercise mat for demountable installation into the first opening defined in the exercise platform framework; and (iv) a second padded exercise mat for demountable installation into the second opening defined in the exercise platform framework.

One aspect of the present disclosure pertains to a second padded exercise mat that is provided with integral pair of side bumper pads. Each pad of said pair extends upward along a side edge of the second padded exercise mat. The second padded exercise mat is demountably positionable into the second opening of the exercise platform with the upward-extending bumper pads adjacent to the side frame rails of the exercise platform. The bumper pads will confine an exercise ball when it is being used to perform core strengthening exercises thereon, to forward and backward motions on the exercise mat thereby significantly reducing the risks of the exercise ball being ejected sideways from underneath the user during their performance of strenuous core exercise routines.

Another aspect of the present disclosure pertains to the second padded exercise mat with an integral pair of side bumper pads, being provided with a third bumper pad interposed the pair of side bumper pads at the distal end of the padded exercise mat. The third bumper pad will reduce the risk of an the exercise ball being ejected backwards from underneath the user during their performance of strenuous core exercise routines.

Other aspects and features of the present disclosure will become apparent to those ordinarily skilled in the art upon review of the following description of specific embodiments of the disclosure in conjunction with the accompanying figures.

BRIEF DESCRIPTION OF THE DRAWINGS

The present disclosure will be described in conjunction with reference to the following drawings, in which:

FIG. 4*a* is a perspective view of the platform component of the apparatus shown in FIG. 1 with an alternative removable mat placed into the rear recess of the platform component, while

FIG. 5*a* is a close-up perspective view of the upper portion of the upright framework of the apparatus shown in FIG. 1, showing the handlebar component in a first position, while

FIG. 6*a* is a close-up perspective view of the lower portion of the upright framework of the apparatus shown in FIG. 1, showing the handgrips in a first position, while

DETAILED DESCRIPTION

Figure 1:
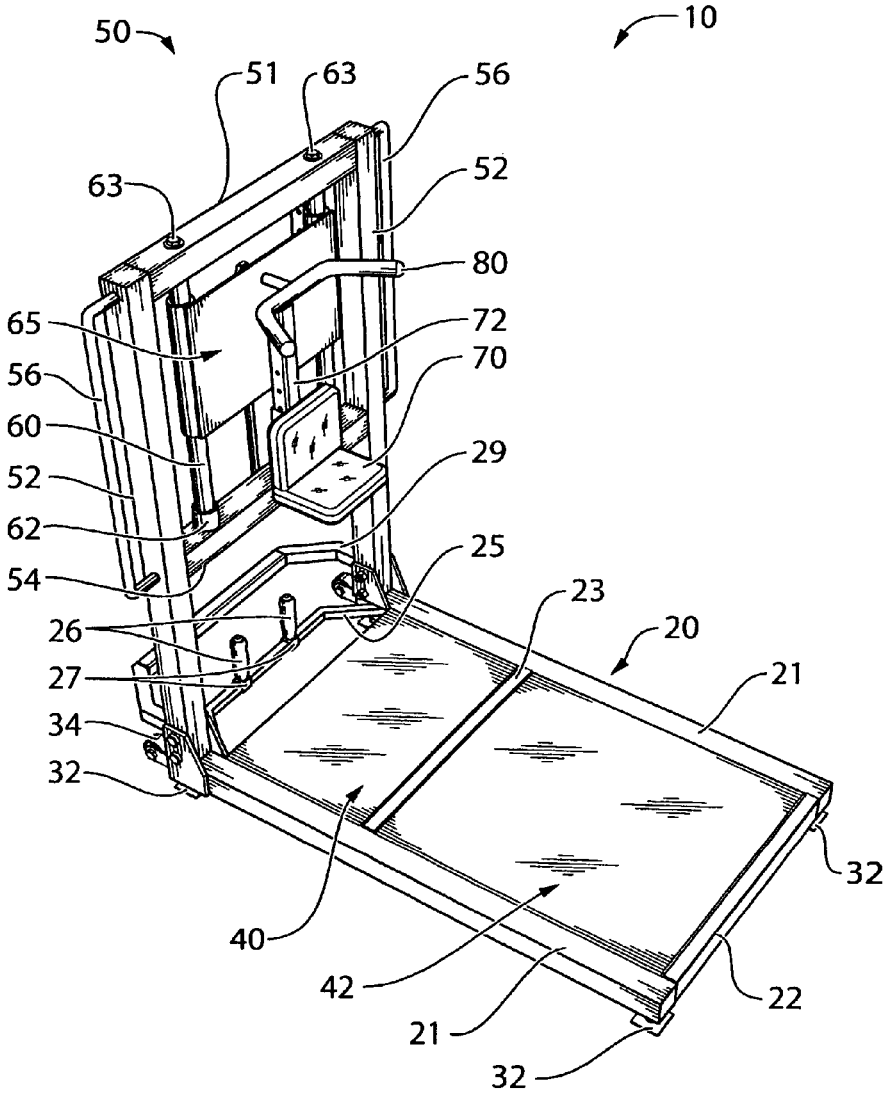
FIG. 1 is a perspective front view of an exemplary apparatus according to the present disclosure.

The exemplary embodiments of the present disclosure pertain to multipurpose exercise apparatus that can be used in combination with exercise balls, for the performance of a wide variety of exercises designed to strengthen users' core muscle groups, while reducing the potential of injuries to the users caused by slippage and/or ejection of exercise balls from underneath them while they are performing core exercises. For clarity, the major core muscles reside in the belly area, the mid back and lower back regions, and peripherally include the hips, the shoulders and the neck.

The exemplary multipurpose exercise apparatus disclosed herein generally comprises two frameworks joined together at one end each at about a 90° angle. One framework extends horizontally as an exercise platform, and comprises two side frame members engaged with an end frame member and an intermediate frame member thereby forming two openings, each opening configured to receive and house a padded exercise mat. The second framework extends vertically from its juncture with the horizontal framework, and has a headrest and a plurality of sets of handgrips. The positions of the headrest and some of the plurality of sets of handgrips can be adjustable for the users' comfort and stability while performing exercises. The second framework, referred to hereafter as the upright framework, may be permanently affixed to the exercise platform framework. Alternatively, the juncture of the upright framework and the exercise framework may be provided with releasably lockable hinges to enable securing the upright framework and the exercise framework at about a 90° angle while in use for performance of exercises, and then to enable unlocking of the frameworks, then folding and securing them together for storage when not in use.

When in use, the padded exercise mat housed in the opening of exercise platform framework at the end opposite to the juncture with the upright framework is removed. An exercise ball may then placed into the cavity defined by the end frame member and the side frame members of the exercise platform. When a user mounts and moves about the exercise ball while performing their core exercises, the exercise ball is maintained within the cavity by the frame members thereby greatly reducing the potential for its ejection from under the user during their performance of strenuous and/or unbalanced exercise maneuvers. Some aspects of the present disclosure relate to exercise pads for demountable installation into the cavity defined by the end frame member and the side frame members of the exercise platform, that are provided with side bumper pads to prevent side-ways ejection of exercise balls from underneath exercising users. Other aspects of the present disclosure relate to exercise pads for demountable installation into the cavity defined by the end frame member and the side frame members of the exercise platform, that are provided with side bumper pads and an end bumper extending between the side bumpers to prevent side-ways and/or rearward ejection of exercise balls from underneath exercising users.

An exemplary embodiment of the multipurpose exercise apparatus of the present disclosure is shown in FIGS. 1-11. The exercise apparatus 10 comprises an exercise platform 20 and an upright framework 50. The exercise platform 20 comprises a base plate 19 (best seen in FIG. 3*b*) affixed to a pair of side frame members 21 integrally engaged with a foot frame member 22, a handgrip support rail 25 integrally engaged with the proximal ends of the side frame members 21, and an intermediate frame member 23. It is to be noted that the base plate 19 is optional and can be omitted from the construction of the exercise apparatus 10 without compromising the structural integrity of the exercise apparatus 10. The opening in the exercise platform 20 defined by the side frame members 21, the handgrip support rail 25 and the intermediate frame member 23 receives a removable exercise mat 40, referred to hereinafter as the front exercise mat 40. The opening in the exercise platform 20 defined by the side frame members 21, the foot frame member 22, and the intermediate frame member 23 receives a removable exercise mat 42, referred to hereinafter as the rear exercise mat 42. The exercise platform 20 is provided with an adjustable foot assembly 32 at each of its four corners to ensure that the exercise platform 20 is securely placed onto a floor of an exercise room. Two hand grips 26 have collars 27 at their bases (best seen in FIG. 1) for receiving therethrough and sliding along the handgrip support rail 25. The side frame members 21 are provided with upward extending brackets 28 at their proximal ends at the front of the exercise platform 20, for receiving therein the ends of the side frame members of the upright framework 50. The upright frame members 52 are secured to the brackets 28 by bolts 53 and nuts (not shown). It is optional if so desired, to replace the top bolt 53 securing each side upright frame member 52 with a demountable hinge pin (not shown) so that the upright framework 50 can be folded down about the lower bolts 53 onto the exercise platform 20, for transport and/or storage. It is optional to replace both bolts 53 inserted into one bracket 28 with two hinge pins (not shown).

The upright framework 50 comprises two upright frame members 52 integrally engaged with a top frame member 51 about the top ends of the upright frame members 52, an intermediate upright frame member 54, and a forward-extending bumper member 29 about the bottom ends of the upright frame members 52. It is optional for the forward-extending bumper member 29 to comprise two end segments projecting forward from the upright frame members 52 with each end segment bent into about a 45° angle and a middle section running in parallel to the handgrip support rail 25 of the exercise platform 20. Alternatively, the forward-extending bumper member 29 may be arcuate. A wheel assembly 34 is attached to each of the side frame members 21 about the proximal end of the exercise platform 20 to enable a person to easily move the exercise apparatus 10 by lifting the foot end of the exercise platform 20 and then moving the exercise apparatus 10 by rolling it forward or backward on the wheel assemblies 34.

Figure 2:
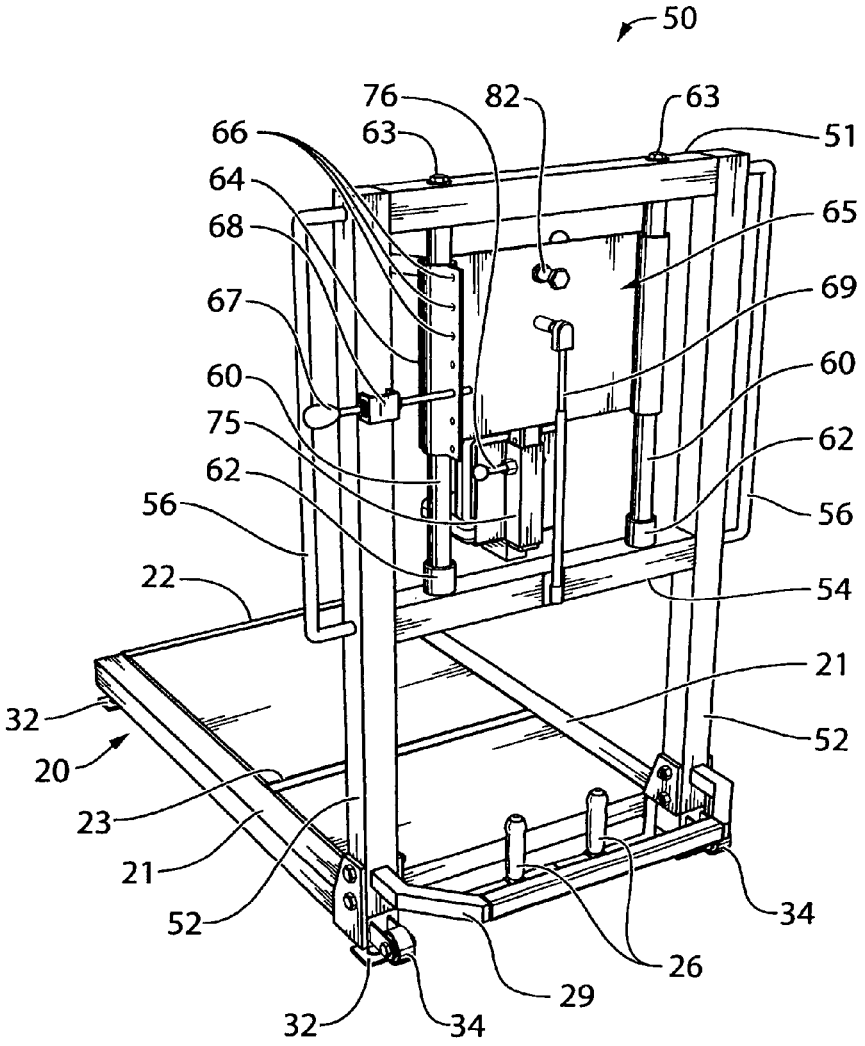
FIG. 2 is a perspective rear view of the apparatus shown in FIG. 1.

The upright framework 50 additionally comprises two spaced-apart upright rails 60 interposed the top frame member 51 and the intermediate upright frame member 54. In the exemplary exercise apparatus 10 shown in FIGS. 1-11, each upright rail 60 is inserted into a bracket 62 and secured in place by a bolt 63 through the top frame member 51. However, the upright rails 60 may be secured into place by other suitable means, for example by welding or alternatively, with bolts inserted through the top frame member 51 and the intermediate upright frame member 54. A backplate 65 formed with opposing longitudinal sleeves, slidingly engages the rails 60 with each upright rail 60 inserted into one sleeve. One of the longitudinal sleeves shown as "64" in FIG. 2) of backplate 65 has a plurality of apertures 66 for demountably receiving a securing rod 67 that slidingly cooperates with a bracket 68 provided therefor on one of the upright frame members 52. The front portion of the backplate 65 has a frame member 72 having a plurality of apertures 74. A headrest 70 is slidingly mounted on to the frame member 72 and secured into place at a desirable height by insertion of a securing rod 76 through an aperture in a bracket 75 provided therefore on the back of the headrest 70 and a selected aperture 74 in the frame member 72. The height of the headrest 70 above the exercise platform can be adjusting by removing securing rod 76 from the headrest bracket and the frame member 72, then sliding the headrest 70 up or down until the aperture in the headrest bracket 75 is aligned with another aperture 74 after which, the securing rod 76 is reinserted into the headrest bracket and the selected aperture 74. A handlebar grip 80 having a mounting rail 82 is secured into a threaded aperture provided therefore in the backplate 65 by a threaded portion 84 at the distal end of the mounting rail 82. The space between the handlebar grip 80 and the backplate 65 can be adjusted by screwing the threaded portion 84 of the mounting rail 82 into or out of the threaded aperture provided therefor in the backplate 65, as shown in FIGS. 5*a*, 5*b*. The height of the handlebar grip 80 above the exercise platform can be adjusting by removing securing rod 67 from the aperture 66 in the longitudinal sleeve 64 of the backplate 65, then sliding the backplate 65 up or down until the securing rod 67 is aligned with another aperture 66 after which, the securing rod 67 is inserted into the selected aperture 66. The combined weight of the backplate 65, the frame member 72, and the headrest 70 may make it difficult for some users to easily adjust the height of the handlebar grip 80 above the exercise platform 20. Therefore, it is optional if so desired, to provide a hydraulic cylinder 69 engaged at one end to the backplate 65 and at its other end to the intermediate upright frame member 54, to provide support to the backplate 65 while the securing rod 67 is disengaged from the backplate 65 and the backplate 65 is being adjusted upward or downward. It is also optional to provide an elongate handgrip 56 on the outer edges of both upright frame members 52 as shown in FIGS. 1, 2. The elongate handgrips 56 may be integrally engaged with the upright frame members 52, for example by welding as shown in FIGS. 1, 2, or alternatively by bolts inserted through the upright frame members 52 into the ends of the elongate handgrips 56 (not shown).

Figure 3A:
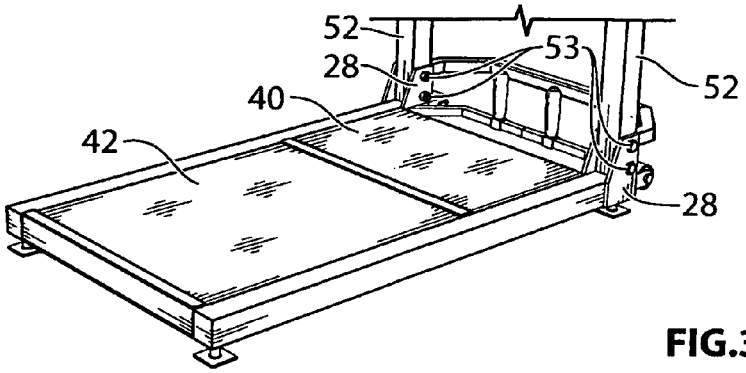
FIG. 3*a* is a perspective view of the platform component of the apparatus shown in FIG. 1 with removable mats placed into recesses provided therefor.
Figure 3B:
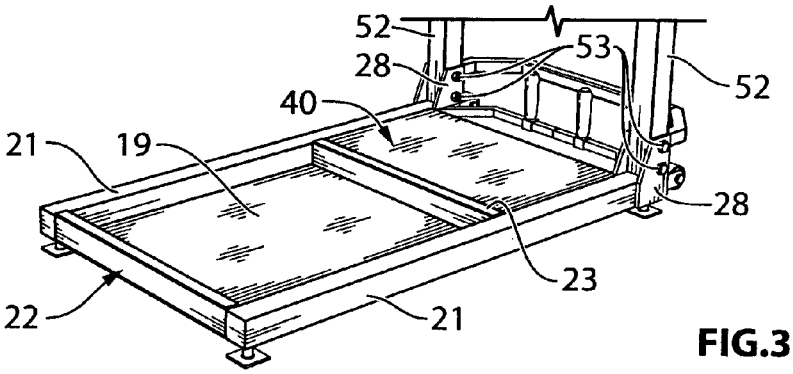
FIG. 3*b*. shows the rear mat removed from rear recess of the platform component.
Figure 3C:
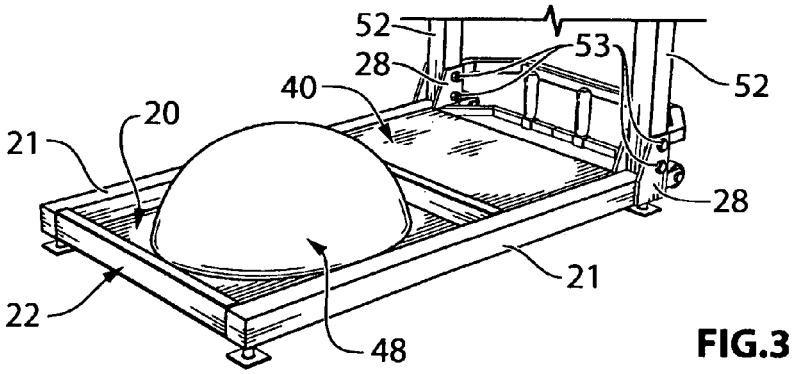
FIG. 3*c* shows a BOSU® balance ball placed into the rear recess of the platform component.
Figure 4A:
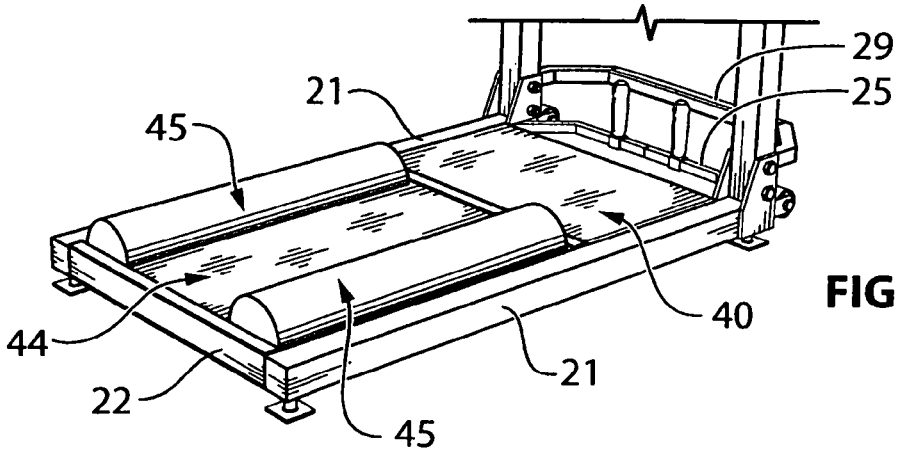

A key element of the exemplary multipurpose exercise apparatus disclosed herein is that the rear exercise mat 42 is removable from the opening in the exercise platform 20 defined by the side frame members 21, the foot frame member 22, and the intermediate frame member 23 as shown in FIGS. 3*a*, 3*b*, 3*c*. An exercise ball 47 (best seen in FIGS. 7-11), can be placed onto the base plate 19 (or alternatively, onto the floor if the exercise platform 20 is not provided with a base plate 19) and used to perform core exercises thereon. The potential for the exercise ball 47 to be unexpectedly ejected from underneath a user during exercises is greatly reduced because it will be confined with the opening defined by the side frame members 21, the foot frame member 22, and the intermediate frame member 23. For greater safety, a ½ exercise ball exemplified by BOSU® balls (BOSU is a registered trademark of Bosu Fitness LLC, San Diego, Calif., USA) may be placed onto the base plate 19 of the exercise platform 20 as shown in FIG. 3*c* or alternatively, into the opening within the exercise frame 20 defined by the side frame members 21, the foot frame member 22, and the intermediate frame member 23.

A plurality of rear exercise mats may be used for insertion into the opening within the exercise platform 20 defined by the side frame members 21, the foot frame member 22, and the intermediate frame member 23. One exemplary rear exercise mat is shown in FIG. 4*a* and comprises a padded exercise mat 44 having two elongate side bumpers 45 integrally engaged in parallel on the two opposing sides of the exercise mat 44. When the exercise mat 44 is placed into the opening within the exercise platform 20 defined by the side frame members 21, the foot frame member 22, and the intermediate frame member 23, the side bumpers 45 are positioned adjacent to and in parallel with the side frame members 21. When an exercise ball 47 is placed onto the exercise mat 44 and used for the performance of exercises, the exercise ball 47 may move forward and backward along the exercise mat 44 between the side bumpers 45. However, the side bumpers 45 will prevent the exercise ball 47 from being ejected sideways from underneath the user during their performance of strenuous core exercise routines.

Figure 4B:
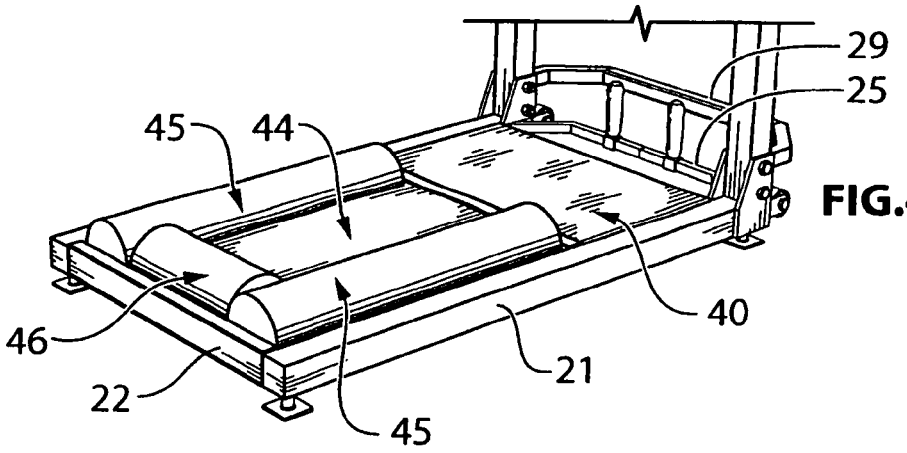
FIG. 4*b* shows another alternative removable mat placed into the rear recess of the platform component.
Figure 5A:
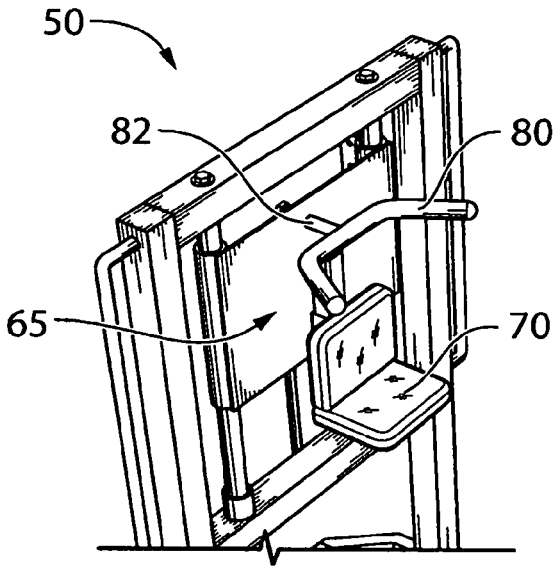
Figure 5B:
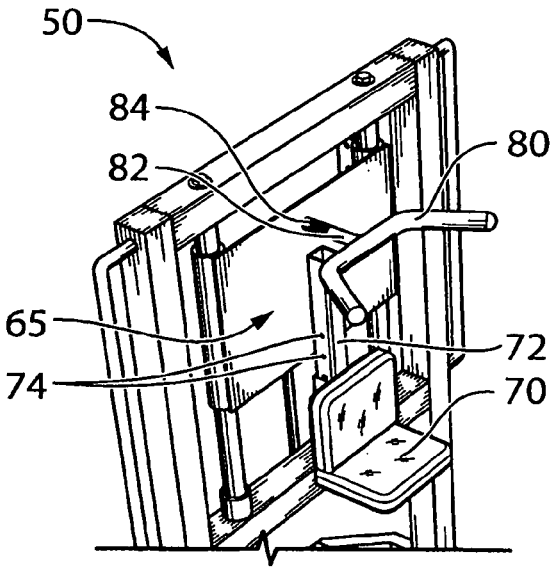
FIG. 5*b* shows the handlebar component in a second position.

Another exemplary rear exercise mat is shown in FIG. 4*b* and comprises a padded exercise mat 44 having two elongate side bumpers 45 integrally engaged in parallel on the two opposing sides of the exercise mat 44, and an additional end bumper 46 integrally engaged with the end of the exercise mat 44 interposed the ends of the side bumpers 45. When the exercise mat 44 is placed into the opening within the exercise platform 20 defined by the side frame members 21, the foot frame member 22, and the intermediate frame member 23, the side bumpers 45 are positioned adjacent to and in parallel with the side frame members 21. When an exercise ball 47 is placed onto the exercise mat 46 and used for the performance of exercises, the exercise ball 47 may move forward and backward along the exercise mat 46 between the side bumpers 45. However, the side bumpers 45 will prevent the exercise ball 47 from being ejected sideways from underneath the user during their performance of strenuous core exercise routines, while the end bumper 46 will prevent the exercise ball 47 from being ejected backwards from underneath the user.

Figure 6A:
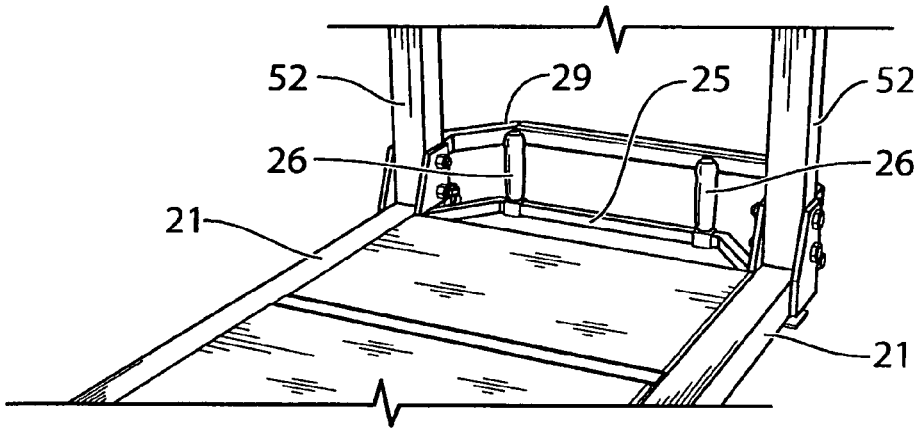
Figure 6B:
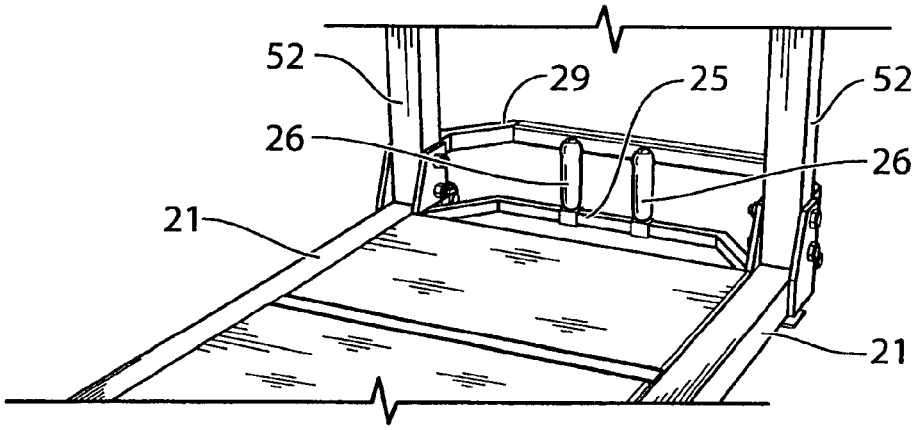
FIG. 6*b* shows the handgrips in a second position.
Figure 7:
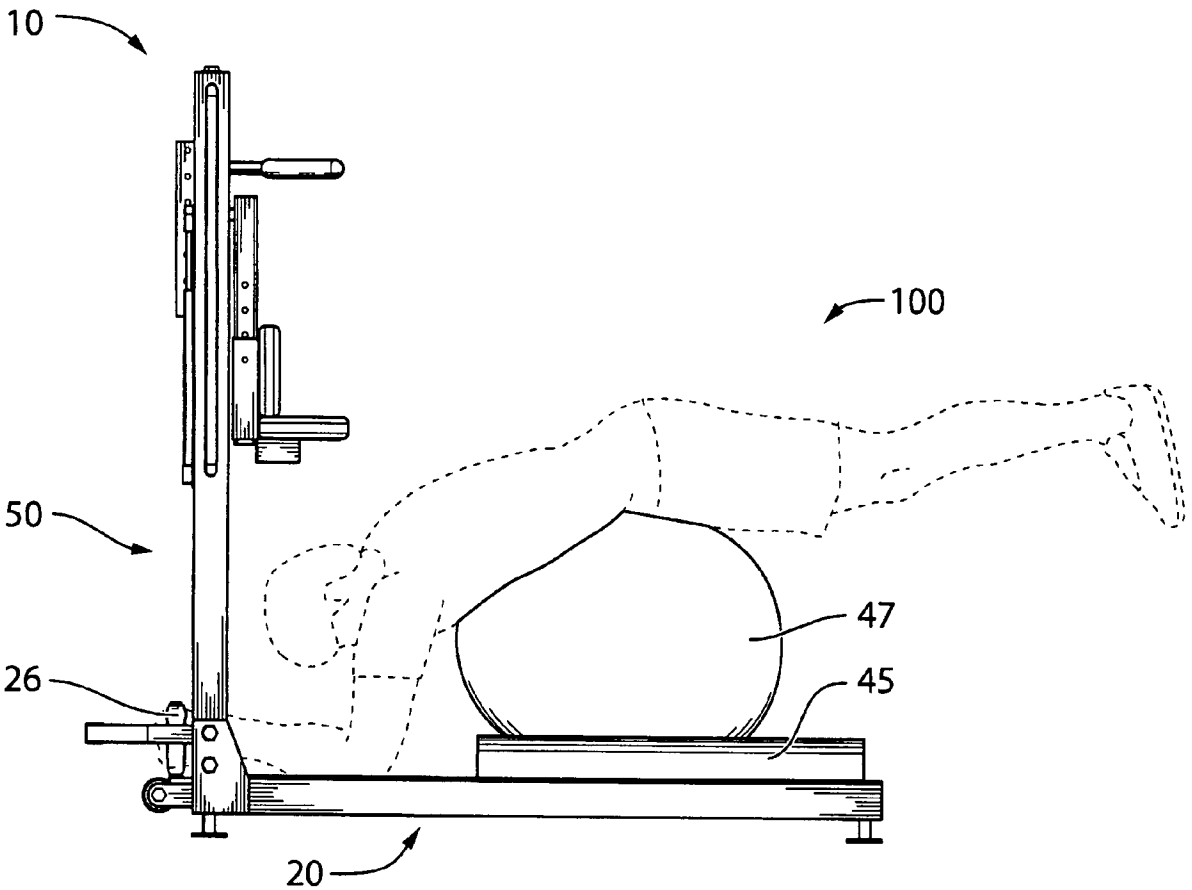
FIG. 7 is a side view of the apparatus from FIG. 1, showing a person gripping the handgrips shown in FIGS. 6*a*, 6*b*, performing a core conditioning exercise on an exercise ball confined within removable mat shown in FIG. 4*a;*

FIGS. 7-11 show an exemplary embodiment of the multipurpose exercise apparatus 10 of the present disclosure used in combination with an exercise ball 47 by a user 100 to perform core exercises thereon. FIG. 7 shows the exercise ball 47 underneath the user's 100 abdomen with the user gripping the handgrips 26 with their elbows resting on the front mat 40 (not visible in FIG. 7 but shown in FIGS. 1-4). The user 100 may then perform leg raises while twisting sideways on the exercise ball 47 which is confined by bumpers 45 to backward and forward movement along exercise mat 44 during the performance of this exercise. To increase the difficulty of performing this particular core exercise and/or improve comfort of use, the user 100 may slide apart the two handgrips 26 over the handgrip support rail 25 as shown in FIG. 6A. Alternatively, the user 100 may slide the two handgrips 26 over the handgrip support rail 25 so they are close together as shown in FIG. 6A.

Figure 8:
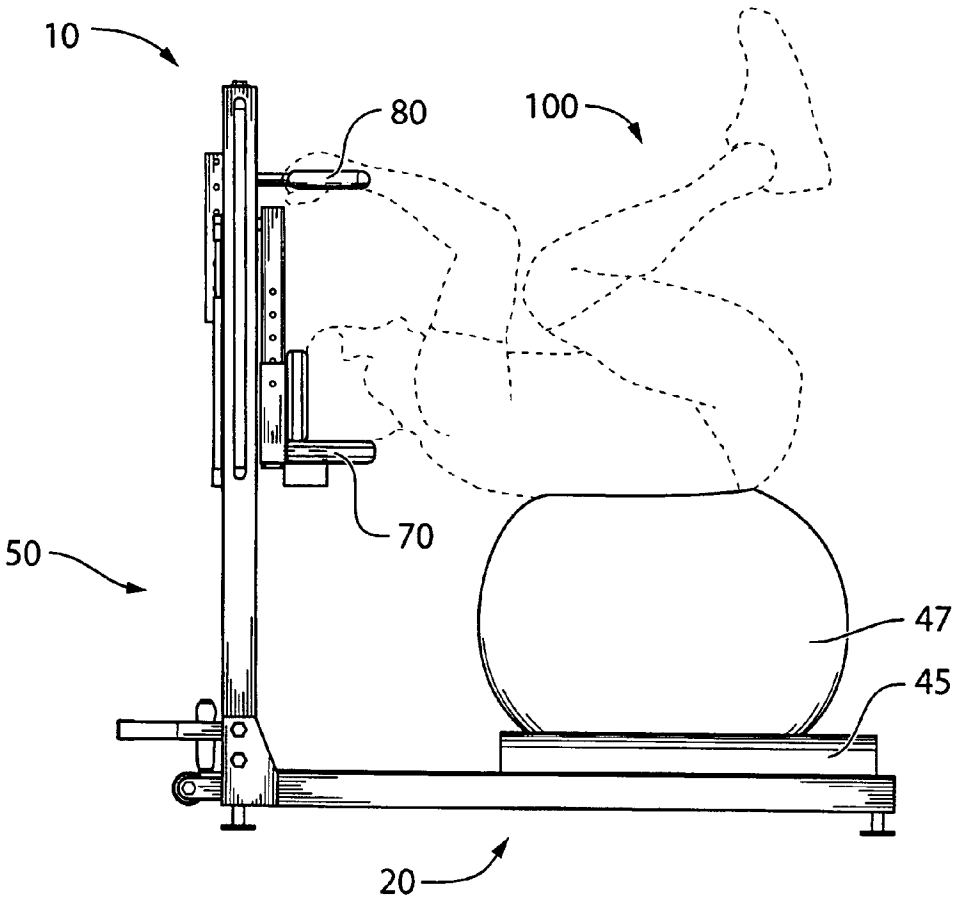
FIG. 8 is a side view of the apparatus from FIG. 1, showing a person gripping the handlebar shown in FIGS. 5*a*, 5*b*, performing another core conditioning exercise on an exercise ball confined within removable mat shown in FIG. 4*a;*
Figure 9:
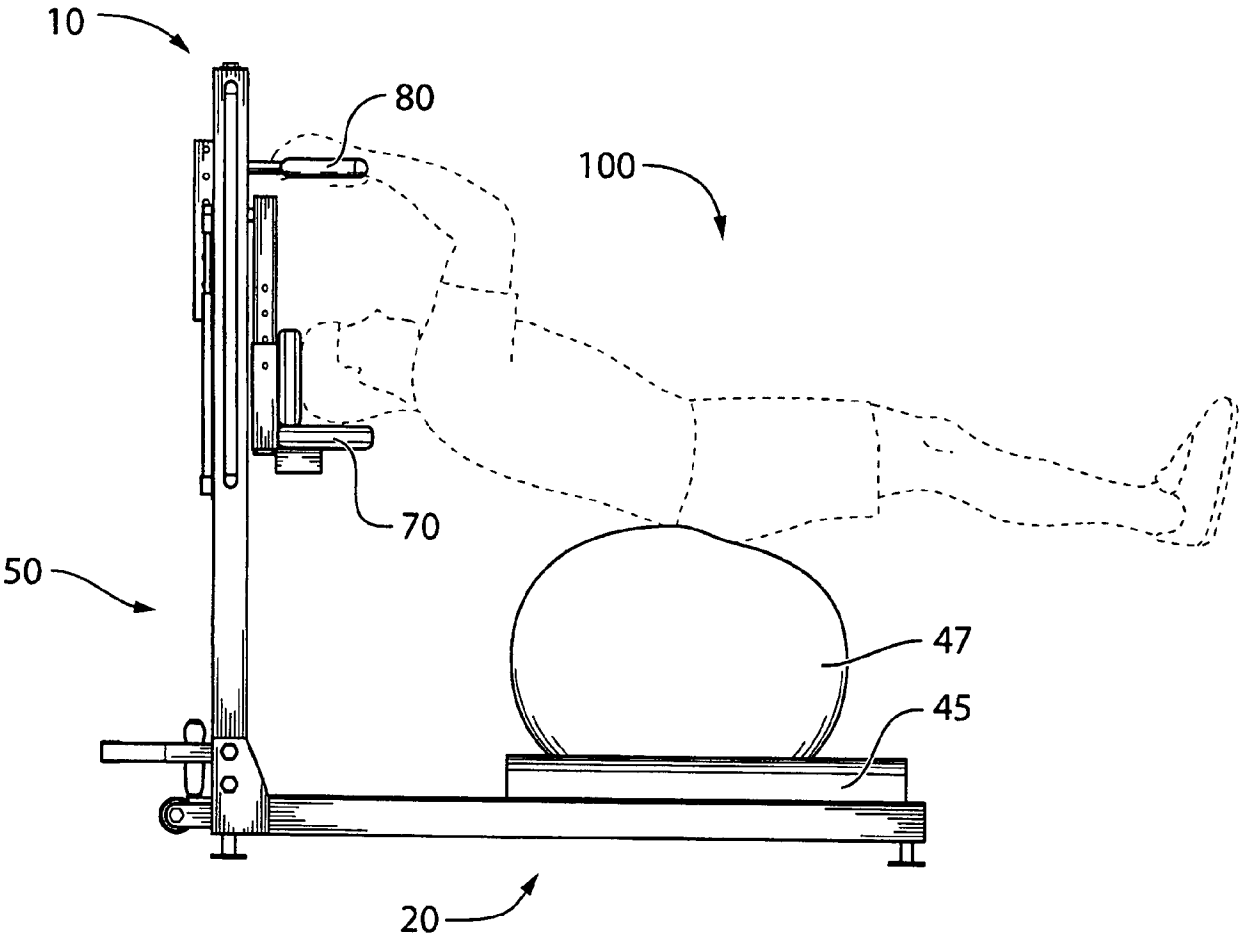
FIG. 9 is a side view of the apparatus from FIG. 8, showing the person gripping the handlebar shown in FIGS. 5*a*, 5*b*, in a different stage of performing the core conditioning exercise.

Another core exercise is depicted in FIGS. 8, 9 wherein the user 100 lays on their back on the exercise ball 47 with their head resting on the headrest 70 while gripping the handlebar grip 80 with their hands. The user may then perform leg extensions from a curled position (FIG. 8) to an extended position (FIG. 9) while twisting sideways on the exercise ball 47, while the exercise ball 47 is confined by bumpers 45 to backward and forward movement along exercise mat 44 during the performance of this exercise.

Figure 10:
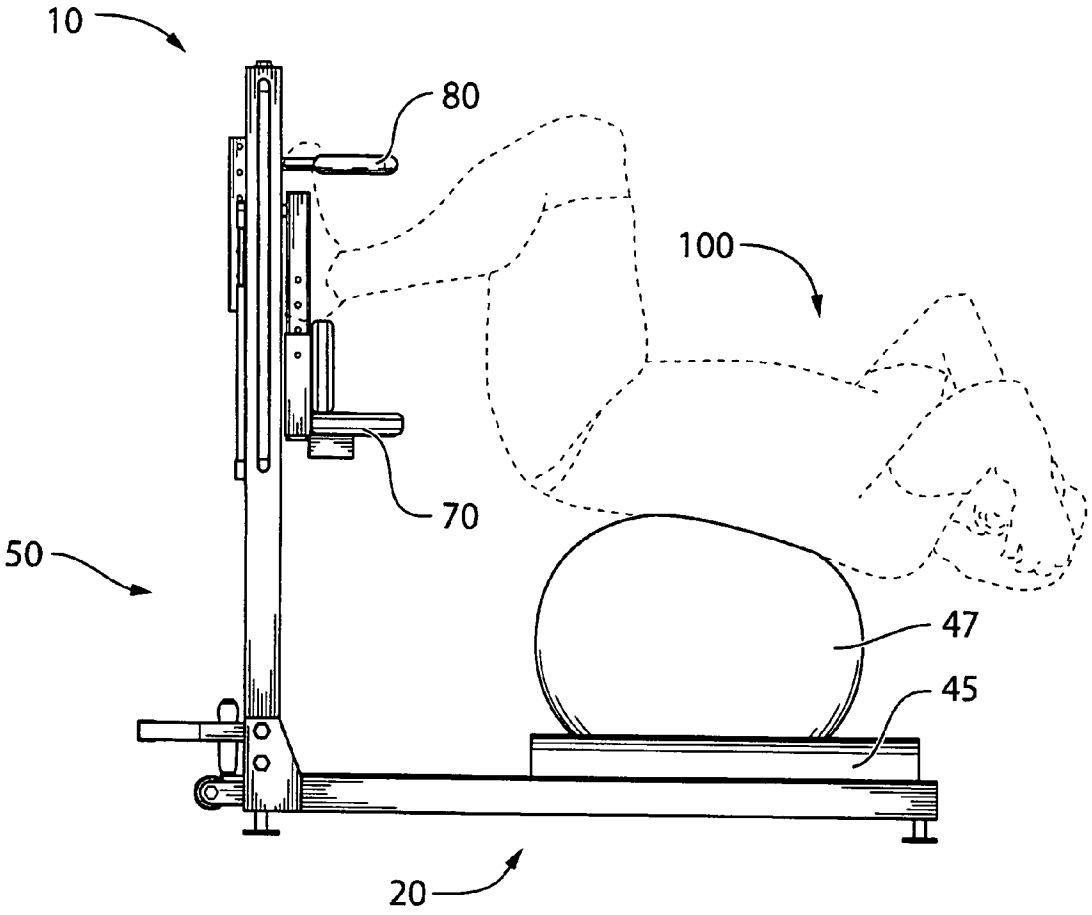
FIG. 10 is a side view of the apparatus from FIG. 1, showing a person with their feet engaged with the handlebar and the headrest shown in FIGS. 5*a*, 5*b*, performing another core conditioning exercise on an exercise ball confined within removable mat shown in FIG. 4*a*.

Another core exercise is depicted in FIG. 10 wherein the user 100 lays on their back on the exercise ball 47 with their feet placed flat on the backplate 65 with their heels resting on the top of the headrest 70 and the tops of their toes pressing against the handlebar grip 80 (the backplate 65, headrest 70, and handlebar grip 80 are best seen in FIG. 1). The user may then perform abdominal curls while twisting sideways on the exercise ball 47, while the exercise ball 47 is confined by bumpers 45 to backward and forward movement along exercise mat 44 during the performance of this exercise.

Figure 11:
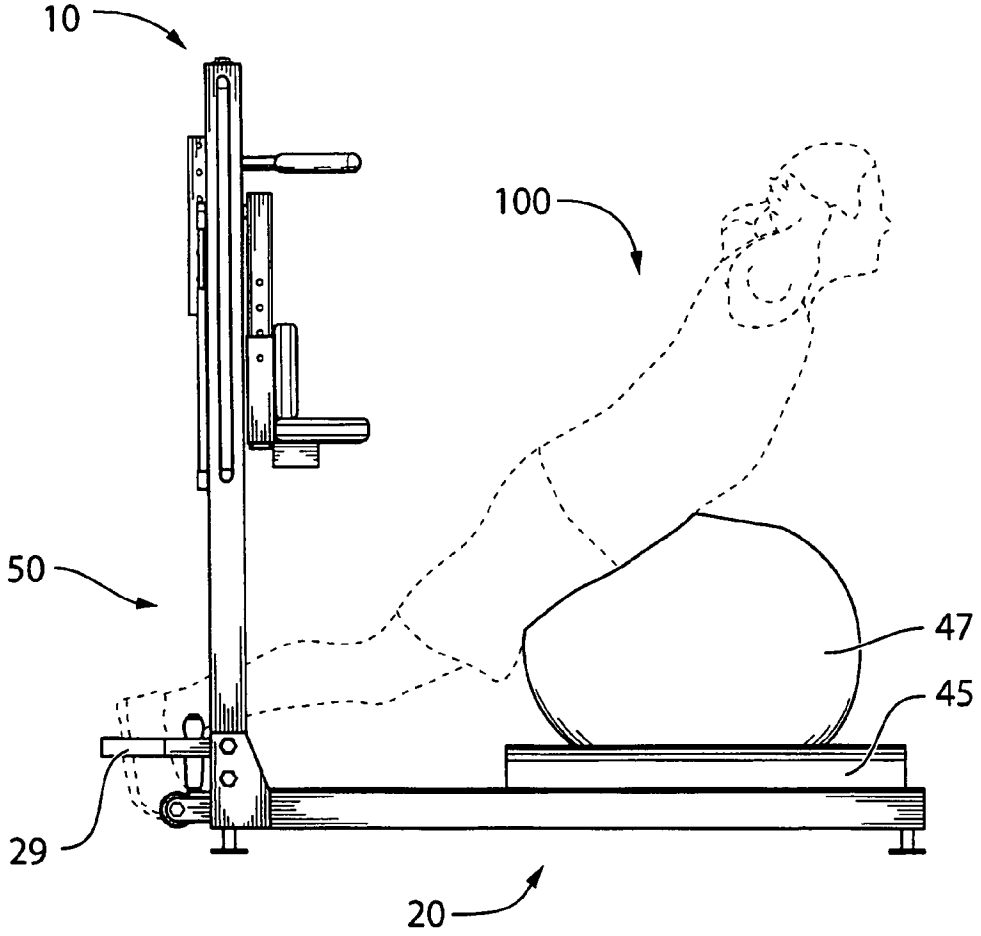
FIG. 11 is a side view of the apparatus from FIG. 1, showing a person with their feet engaged with the bottom portion of the upright framework of the apparatus shown in FIGS. 6*a*, 6*b* and the headrest shown in FIGS. 4*a*, 4*b*, performing core conditioning exercises on an exercise ball confined within removable mat shown in FIG. 4*a.*

Another core exercise is depicted in FIG. 11 wherein the user 100 has the exercise ball 47 underneath their abdomen while their feet stably engage the upright framework stabilizer bar 29 with the underside of their feet and the handgrip support rail 25 with the tops of their toes (the upright framework stabilizer bar 29 the handgrip support rail 25 are best seen in FIGS. 1, 4). The user may then perform head and upper torso raises on the exercise ball 47 while the exercise ball 47 is confined by bumpers 45 to backward and forward movement along exercise mat 44 during the performance of this exercise.

While the core exercises depicted in FIGS. 7-11 illustrate the use of an exercise mat having two side bumpers only (as shown in FIG. 4*a*) for confining therein the exercise ball to prevent sideways ejection of the exercise ball from underneath a user during exercising, it suitable to use an exercise mat having two side bumpers and an end bumper (as shown in FIG. 4*b*) to prevent sideways and/or rearward ejection of the exercise ball from underneath a user during exercising. It is also to be noted that, if so desired, the exercise pads with the two side bumpers and the two side bumpers with an end bumper, can be used alone on a floor surface to hold an exercise ball in place while performing core exercise without the multipurpose exercise apparatus disclosed herein. However, it is to be further noted that, if so desired, a padded exercise mat without bumpers disclosed herein, can be used in the opening within the exercise platform 20 defined by the side frame members 21, the foot frame member 22, and the intermediate frame member 23. The compression of an exercise ball by a user's weight into the padded exercise mat without bumpers will cause padded mat to absorb some pressure from exercise ball exerted by the user's weight, and thereby provide a greater measure of resistance to sideways ejection of the exercise ball from underneath the user when compared to the use of an exercise ball on a hard floor surface.

The invention claimed is:

1. An exercise apparatus comprising:

an exercise platform comprising a fixed framework defining a first recessed opening approximate a proximal end of the exercise platform and a second recessed opening approximate a distal end of the exercise platform, said fixed framework having a handgrip support rail integrally engaged with its proximal end;

and an upright framework engaged with the exercise platform framework at the proximal end of the exercise platform, the upright framework having:

i. two upright frame members engaged with a top frame member, an intermediate frame member, and a lower stabilizer bar, ii. two spaced-apart upright rails interposed between the two upright frame members, said two spaced-apart upright rails engaged with the top frame member and the intermediate frame member, iii. a vertically adjustable backplate releasably engaged with the two spaced-apart upright rails, iv. a vertically adjustable headrest engaged with the backplate and extending downward therefrom, and v. an adjustable handlebar grip engaged with the backplate above said headrest.

2. The exercise apparatus of claim 1, additionally comprising a first padded exercise mat demountably engaged in the first recessed opening of the exercise platform framework.

3. The exercise apparatus of claim 2, additionally comprising a second padded exercise mat demountably engaged in the second recessed opening of the exercise platform platform framework.

4. The exercise apparatus of claim 3, wherein the second padded exercise mat comprises an integral parallel pair of bumper pads, each pad of said pair extending upward along a side edge of the second padded exercise mat.

5. The exercise apparatus of claim 4, wherein the second padded exercise mat additionally comprises an integral bumper pad extending upward along a distal edge of the second padded exercise mat.

6. The exercise apparatus of claim 1, wherein the exercise platform framework defines four corners and has an adjustable foot assembly mounted about each corner.

7. The exercise apparatus of claim 1, additionally comprising a pair of wheel assemblies mounted to the proximal end of the exercise platform framework.

8. The exercise apparatus of claim 1, wherein the handlebar grip is adjustable to extend farther from or closer to the backplate.

9. The exercise apparatus of claim 1, wherein a pair of handgrips is slidingly engaged with the handgrip support rail.

10. The exercise apparatus of claim 1, wherein each of the two upright frame members has an elongate handgrip extending outwardly therealong.

11. The exercise apparatus of claim 1, wherein the upright framework is hingedly coupled to the proximal end of the exercise platform.

12. An exercise apparatus for receiving therein and cooperating with an exercise ball for performance of core exercises thereon, the exercise apparatus comprising:

an exercise platform comprising a framework defining a first opening approximate its proximal end for receiving therein a first padded exercise mat and a second opening approximate its distal end for receiving therein a second padded exercise mat and/or an exercise ball;

an upright framework engaged with the exercise platform framework at its proximal end, the upright framework having: (i) a vertically adjustable backplate with an adjustable headrest mounted thereon and an adjustable handlebar grip mounted thereon, (ii) a handgrip support rail integrally engaged with the proximal end of the exercise platform, and (iii) a stabilizer bar integrally engaged with a lower portion of the upright framework;

the first padded exercise mat for demountable installation into the first opening defined in the exercise platform framework; and the second padded exercise mat for demountable installation into the second opening defined in the exercise platform framework, wherein the second padded exercise mat comprises an integral parallel pair of bumper pads, each pad of said pair extending upward along a side edge of the second padded exercise mat.

13. The exercise apparatus of claim 12, wherein the second padded exercise mat additionally comprises an integral bumper pad extending upward along a distal edge of the second padded exercise mat.

* * * * *